United States Patent [19]

Tra

[11] Patent Number: 4,812,229

[45] Date of Patent: Mar. 14, 1989

[54] SCREEN CAGE

[75] Inventor: Josef Tra, Heidenheim, Fed. Rep. of Germany

[73] Assignee: J. M. Voith GmbH, Heidenheim, Fed. Rep. of Germany

[21] Appl. No.: 22,264

[22] Filed: Mar. 5, 1987

[30] Foreign Application Priority Data

Mar. 7, 1986 [DE] Fed. Rep. of Germany ..... 3607457

[51] Int. Cl.[4] ..... B07B 1/46

[52] U.S. Cl. ..... 209/397; 209/273

[58] Field of Search ..... 209/273, 270, 305, 306, 209/397, 379, 380; 210/498, 397; 162/55

[56] References Cited

U.S. PATENT DOCUMENTS

| | | | |
|---|---|---|---|
| 226,819 | 4/1880 | Zeyen | 209/397 |
| 1,631,585 | 6/1927 | D'Olier et al. | 210/498 |
| 2,301,514 | 11/1942 | Brewster | 209/397 |
| 2,827,169 | 3/1958 | Cusi | 209/397 |
| 3,409,132 | 11/1968 | Meadows | 209/273 |
| 4,017,387 | 4/1977 | Hatton et al. | 209/273 |
| 4,276,159 | 6/1981 | Lehman | 209/397 |
| 4,529,520 | 7/1985 | Lampenius | 209/397 |
| 4,571,298 | 2/1986 | Holz | 210/498 |
| 4,640,364 | 2/1987 | Theurer | 209/397 |
| 4,717,471 | 1/1988 | Winkler | 209/273 |

FOREIGN PATENT DOCUMENTS

| | | | |
|---|---|---|---|
| 0079811 | 10/1982 | European Pat. Off. | 209/273 |
| 143894 | 1/1902 | Fed. Rep. of Germany | 210/498 |
| 502731 | 7/1930 | Fed. Rep. of Germany | 209/397 |

*Primary Examiner*—Robert B. Reeves
*Assistant Examiner*—Donald T. Hajec
*Attorney, Agent, or Firm*—Albert L. Jeffers; Richard L. Robinson

[57] ABSTRACT

The screen wire has depressions (5), on the base of which there are fine slits (4) or wire holes. The depressions are generally oblong, their longitudinal extension being parallel or slightly inclined to the axis of rotation of a rotor and the screening blades (2) skirting close to the screen surface. The front edge of the depressions (5)—viewed in the direction of rotation of the screening blades (2)—is inclined towards the enveloping surface of the screen, and has an angle of between 15° and 60° from the surface perpendicular and is preferably inclined at 30°. The slits or rows-of-holes run parallel to the front edge of the depressions (5). These screen cages for the screening of screening fiber suspensions provide better screening efficiency and they have less blockage.

8 Claims, 1 Drawing Sheet

Fig.1
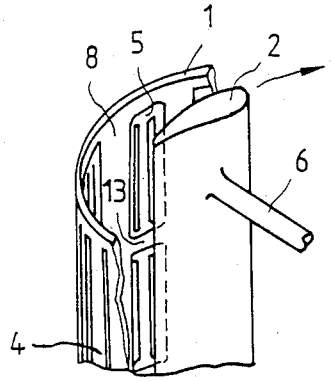
Fig. 2
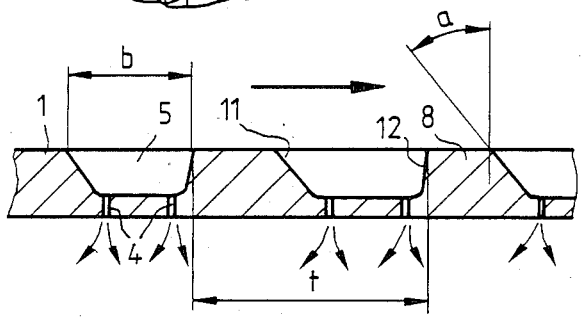
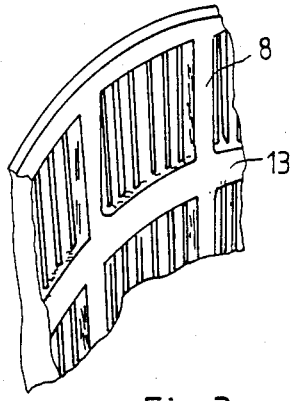
Fig.3
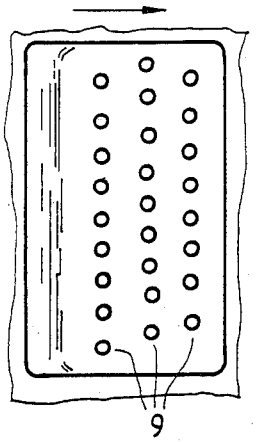
Fig. 4

SCREEN CAGE

The invention relates to a screen for screening fiber suspensions. Screens are used both as flat screens and as rotationally symmetric screen cages in many applications, in particular in the paper industry, for various screening tasks. For example, the screens are used for final screening of the suspension product fibers and also to provide a pure fiber suspension from waste paper. These screening tasks have recently become very demanding with the result that the screen slit widths have already dropped below 0.3 mm. Consequently the risk of screen blockage is increased or the screening efficiency is reduced.

The object of the invention is to provide a screen which has good screening performance, that is good screening efficiency with a good throughput, without any risk of blockage and with the percentage of good fibers passing through the screen as high as possible.

The invention provides a screen having a plurality of parallel slits or rows of holes in depressions on the influx side of the screen. The depressions are essentially oblong rectangles with the slits or rows of holes generally parallel to the longitudinal edge of the rectangle. The slits or holes may be inclined at an angle up to 35° from the generatrix of the surface of the screen cage. The lateral front surface of the depression is inclined at an angle between 15° and 60° from a line normal to the cage surface generatrix and suspension flow direction to form an extension of the depression from the depression base.

U.S. Pat. No. 4,529,520 discloses an arrangement which provides only one slit or one row of holes for each depression. This is intended to prevent any felting of the layer of fibers on the surface of the screen, particularly by stipulating longer fibers, which would cause a sharp rise in the flow resistance of the screen. The depression design in this device can only be very flat. This has the disadvantage that the screen scan only be used with low suspension densities, and the depressions quickly become ineffective due to wear at the edges.

The present invention reduces the risk of the screen blockage, even with higher suspension consistencies, because there is more space available in the depressions particularly for the larger elements, such as impurities and specks. Moreover screen efficiency is not impaired if the edges of the depressions are worn.

EP No. 00 79 811 discloses an arrangement similar to the above-described apparatus. However, this structure has a single row of holes for each groove, and the holes of one groove wall are intended to be directly adjacent or adjoining to facilitate the passage through the holes of the fibers on their direct path by reflection on the groove wall.

BRIEF DESCRIPTION OF THE DRAWINGS

The invention is explained below with reference to an exemplary embodiment shown in the figures, in which:

FIG. 1 is a partial view of a section of the screen cage;

FIG. 2 is a sectional view through a screen cage at right angles to the slits on an enlarged scale;

FIG. 3 is an alternative embodiment of a screen cage; and

FIG. 4 is a further screen embodiment with rows of holes.

DETAILED DESCRIPTION OF THE INVENTION

As shown in FIG. 1, screen cage 1 on the influx side rotates in the direction of the arrow with the screening blades 2 held by supporting arms 6 at a short distance from the surface of the screen cage. The screening blades 2 are airfoil like elements and produce pressure pulses in the vicinity of the surface of the screen cage, which pulses are transmitted into the depressions 5 and apertures 4. The depressions 5 give the screen cage 1 a broken surface, which is no longer smooth. The depressions 5 also produce a rotational field in the flow, which prevents blockage of the apertures 4. In addition, relatively long fibers can also force their way through the screen slits 4. Heavy or larger particles of dirt, which get into these side depressions, can therefore more easily be deposited and not cause any blockage. Therefore, the quantity of accepts or accepted fibers, which pass through the screen, is relatively large.

The screen slits 4 are preferably parallel to the axis of rotation and the output end of the surface line of the screen cage 1. The depressions are interpersed by crossbars 13 in the axial direction of the rotor blades 2 to give the screen cage greater strength. Two to four parallel screen slits or corresponding rows 9 of wire holes are preferably provided for each depression 5. The widths of the screen slits may be less than 0.45 mm, and even less than 0.30 mm. Best use of the turbulence produced by the depressions is provided with only two (at most three) slits for each depression.

The front side 11 of the depressions 5 forms an angle a, which is between 15° and 60°, and is preferably between 35° an 50° with respect to the direction of rotation of the screening blades 2 or the suspension flow direction to the screen surface (see thick arrows), and the vertical on the surface or direction of flow (thick arrow). The suspension flow direction is generally tangential to the cage screen. The rear surface 12 scarcely deviates from the screen surface vertical, which results in a very small slit pitch and a very large free screen transit area of the cage.

The depressions 5 have a depression width b which is at least ten times the slit width of slits 4 or, alternatively, where rows of holes 9 are employed, depression width b is at least 5 times the width of the holes 9.

A flat screen is preferably used for vibration screens. Cages having screening blades passing close to the surface, as shown in FIG. 1, utilize slits 4 or rows 9 of holes running paralel to or slightly inclined with angles of between 0° and 35° from the axis of rotation. In this emboidment, the screening effect produced is most favorable for screening devices having fine slits or narrow holes, generally known as vertical screens.

While only particular embodiments of the invention have been described and claimed herein, it is apparent that various modifications and alterations of the invention may be made. It is therefore the intention in the appended claims to cover all such modifications and alterations as may fall within the true spirit and scope of the invention.

The crossbars 8 e.g., remaining generally of the solid material of the cage between the depressing 5 may be very slim or narrow in cross-section, by this way generating even more free screen transit area, because relatively more screening openings can be placed, when the screen opening pitch is diminished.

What is claimed is:

1. A rotationally symmetric cage screen for screening fiber suspenson, which fiber suspension has a flow direction generally tangential to said cage screen, said cage screen having an influx side and a cage surface generatrix, said cage screen comprising:

a plurality of depressions at small intervals on said influx side, each of said depressions having a depression width, each of said depressions having a base and a front lateral surface inclined at an angle between about 15° and 60° from a line normal to said cage surface generatrix and extending from the base in a direction contrary to the flow direction;

a plurality of slits provided in said screen at an angel between about 0° and 35° from said cage surface generatrix, at least two of said plurality of slits provided in each of said plurality of depressions and arranged successively in the flow direction, each of said plurality of slits having a slit width; and, said depression width being at least ten times said slit width.

2. A screen as claimed in claim 1 wherein said plurality of slits in said base of each depression is between two and four, inclusive.

3. A screen as claimed in claim 1 wherein said front lateral surface of said depressions is inclined at an angle between about 35° and 50° from a line normal to said cage surface generatrix.

4. A screen as claimed in claim 1 wherein said plurality of slits in said base of each depression is two slits.

5. A rotationally symmetric cage screen for screening fiber suspension, which fiber suspension has a flow direction generally tangential to said cage screen, said cage screen having an influx side and a cage surface generatrix, said cage screen comprising:

a plurality of depressions at small intervals on said influx side, each of said depressions having a depression width, each of said depressions having a base and a front lateral surface inclined at an angle between about 15° and 60° from a line normal to said cage surface generatrix and extending from the base in a direction contrary to the flow direction;

a plurality of rows-of-holes provided in said screen at an angle between about 0° and 35° from said cage surface generatrix, at least two of said plurality of rows-of-holes provided in each of said plurality of depressions and arranged successively in the flow direction, each of said plurality of rows-of-holes having a hole width; and, said depression width being at least five times said hole width.

6. A screen as claimed in claim 5 wherein said plurality of rows-of-holes in said base of each depression is between two and four, inclusive.

7. A screen as claimed in claim 5 wherein said front lateral surface of said depressions is inclined at an angle between about 35° and 50° from a line normal to said cage surface generatrix.

8. A screen as claimed in claim 5 wherein said plurality of rows-of-holes in said base of each depression is two rows-of-holes.

* * * * *

UNITED STATES PATENT AND TRADEMARK OFFICE

CERTIFICATE OF CORRECTION

PATENT NO. : 4,812,229

DATED : March 14, 1989

INVENTOR(S) : Josef Tra

It is certified that error appears in the above-identified patent and that said Letters Patent is hereby corrected as shown below:

Col. 1, line 41, change "scan" to --can--;
Col. 2, line 34, change "an" to --and--;
Col. 2, line 50, change "paralel" to --parallel--;
Col. 2, line 63, change "depressing" to --depressions--;
Claim 1, Col. 3, line 14, change "angel" to --angle--.

Signed and Sealed this

Twenty-sixth Day of September, 1989

*Attest:*

DONALD J. QUIGG

*Attesting Officer*

*Commissioner of Patents and Trademarks*